US007287664B2

(12) United States Patent
Hagan et al.

(10) Patent No.: US 7,287,664 B2
(45) Date of Patent: Oct. 30, 2007

(54) STORAGE BOX HANDLE

(75) Inventors: John Hagan, Roscoe, IL (US); Paul E. King, Louisville, KY (US); Don Shaner, Winnebago, IL (US); George Boss, Jr., Floyds Knobs, IN (US)

(73) Assignee: Textron Innovations Inc., Providence, RI (US)

( * ) Notice: Subject to any disclaimer, the term of this patent is extended or adjusted under 35 U.S.C. 154(b) by 538 days.

(21) Appl. No.: 10/834,679

(22) Filed: Apr. 29, 2004

(65) Prior Publication Data

US 2005/0242104 A1 Nov. 3, 2005

(51) Int. Cl.
*B65D 35/28* (2006.01)
*B65D 25/32* (2006.01)

(52) U.S. Cl. ..... 220/761; 16/408; 16/409; 220/762; 220/765; 220/766; 220/770

(58) Field of Classification Search ..... 220/761, 220/759, 762, 765, 766, 772, 770; 16/408, 16/409, 416, 418
See application file for complete search history.

(56) References Cited

U.S. PATENT DOCUMENTS

| | | | | |
|---|---|---|---|---|
| 597,217 | A * | 1/1898 | Loery | 220/765 |
| 711,466 | A * | 10/1902 | Bronson, Jr. | 220/647 |
| 0,758,482 | A | 4/1904 | Smith | |
| 919,360 | A * | 4/1909 | Kamenstein | 220/766 |
| 1,003,225 | A * | 9/1911 | Wootten | 16/445 |
| 1,094,820 | A * | 4/1914 | Sargent | 16/408 |
| 2,401,399 | A | 6/1946 | Akers | |
| 2,444,056 | A * | 6/1948 | McCarl | 16/445 |
| D207,835 | S | 6/1967 | Dexter | |
| 5,012,553 | A * | 5/1991 | Hardigg et al. | 16/445 |
| D368,012 | S | 3/1996 | Dickinson et al. | |
| D394,157 | S | 5/1998 | Dickinson et al. | |
| RE37,518 | E * | 1/2002 | Hardigg et al. | 16/438 |
| 6,397,436 | B1 * | 6/2002 | Wang | 16/445 |
| 6,464,095 | B2 * | 10/2002 | Samsel | 220/4.22 |
| D493,618 | S | 8/2004 | DeCarlo et al. | |
| 6,988,633 | B2 * | 1/2006 | Grinnall et al. | 220/770 |

* cited by examiner

*Primary Examiner*—Anthony D. Stashick
*Assistant Examiner*—Niki M. Eloshway
(74) *Attorney, Agent, or Firm*—Trexler, Bushnell, Giangiorgi, Blackstone & Marr, Ltd.

(57) ABSTRACT

A handle assembly includes a mounting bracket and a handle. The mounting bracket supports the handle which can pivot relative to the mounting bracket. The mounting bracket includes first and second mounting elements which prevent the handle from rotating more than approximately ninety degrees relative to the mounting bracket.

24 Claims, 5 Drawing Sheets

STORAGE BOX HANDLE

BACKGROUND OF THE INVENTION

This invention is generally directed to a handle assembly for use in connection with a storage box.

Handles commonly used on storage boxes protrude outside the dimensions of the storage box when not in use. In addition, these handles include multiple parts which required assembly and therefore increased the time and cost of manufacturing and assembly of the multiple pieces to form the handle assembly.

The present invention provides a handle assembly which overcomes the problems presented in the prior art and which provides additional advantages over the prior art, such advantages will become clear upon a reading of the attached specification in combination with a study of the drawings.

OBJECTS AND SUMMARY OF THE INVENTION

A general object of the present invention is to provide a handle assembly which is cost efficient to manufacture.

Yet another general object of the present invention is to provide a handle assembly which limits the pivotal movement of the handle.

Another object of the present invention is to provide a handle which can be formed from a single piece of material.

An further object of the present invention is to provide a handle assembly which does not extend beyond the dimensions of the storage box when the handle is not in use.

Yet a further object of the present invention is to provide a handle assembly which can be used as a security tie down.

A specific object of the present invention is to provide a handle which is comfortable to grasp.

Briefly, and in accordance with the foregoing, the present invention discloses a handle assembly to be mounted to a storage box. The handle assembly includes a mounting bracket permanently secured to the storage box and a handle formed from a single piece of material supported by the mounting bracket.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE ILLUSTRATED EMBODIMENT

Figure 1:
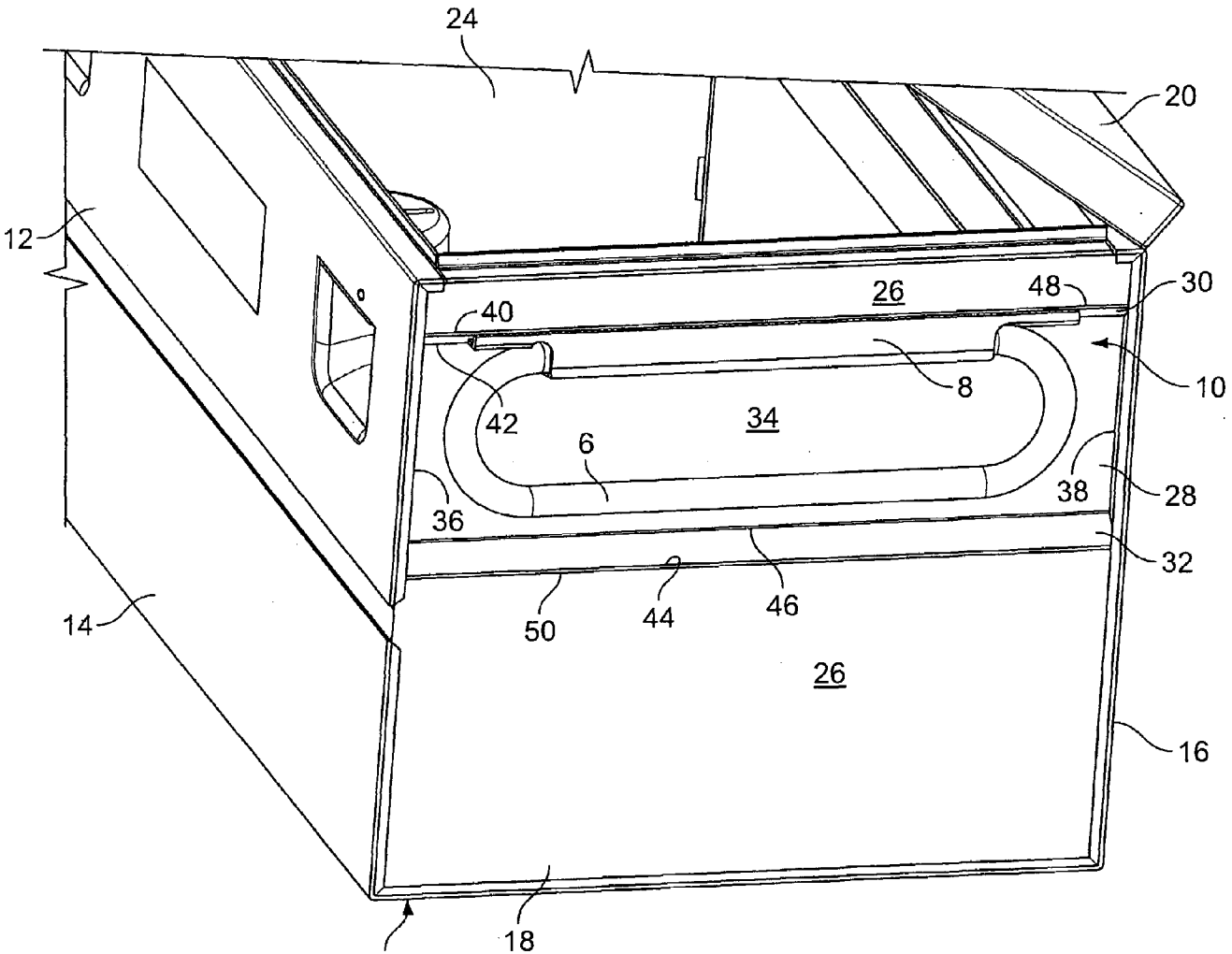
FIG. 1 is a perspective view of handle assembly which incorporates the features of the invention mounted to a storage box, a portion of the storage box is shown.
Figure 2:
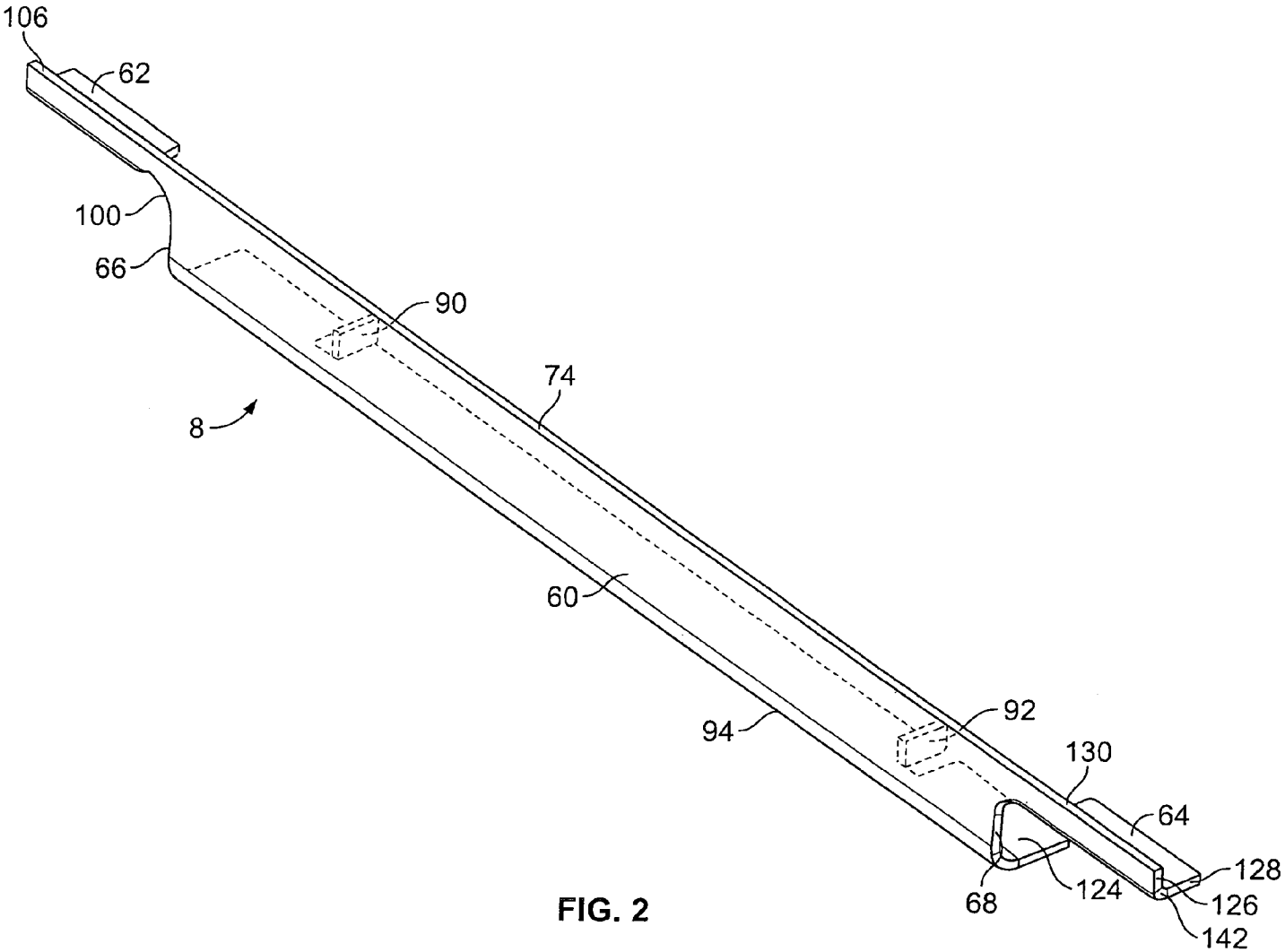
FIG. 2 is a perspective view of the mounting bracket of the handle assembly shown in FIG. 1.
Figure 3:
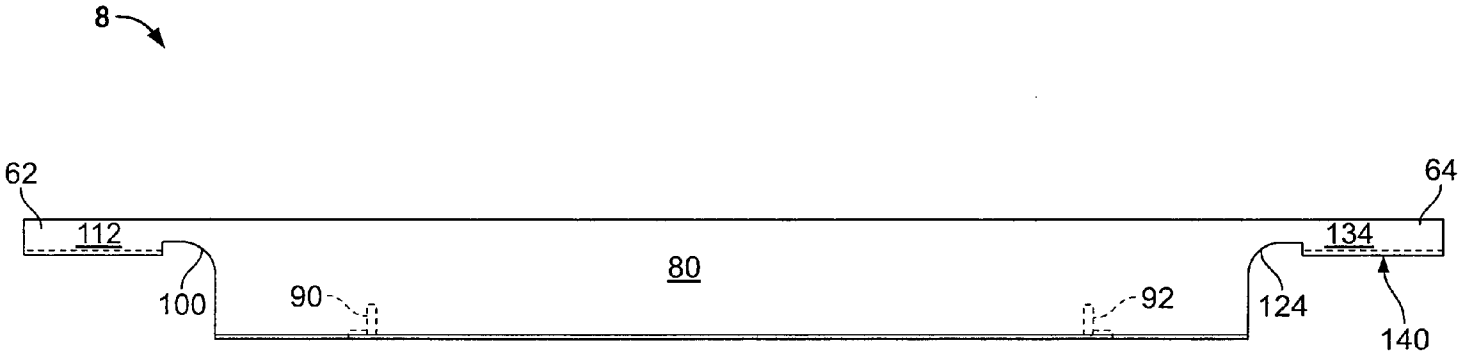
FIG. 3 is a side elevational view of the mounting bracket of FIG. 2.
Figure 5:
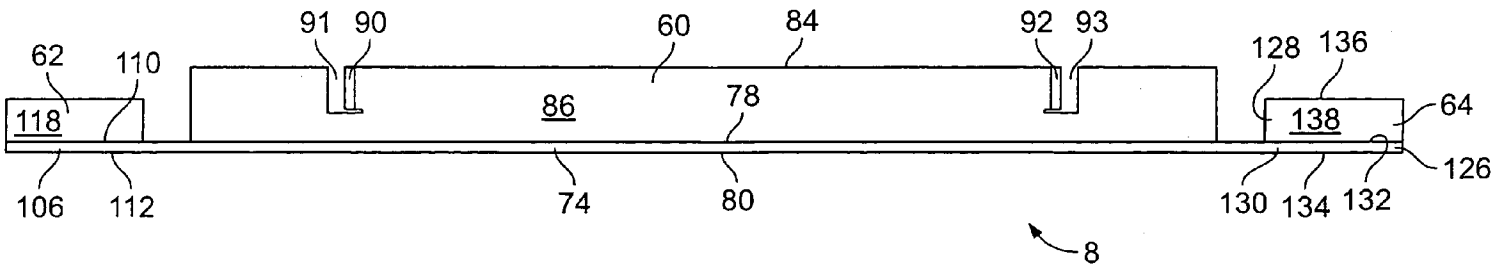
FIG. 5 is a top plan view of the mounting bracket of FIG. 2.

While the invention may be susceptible to embodiment in different forms, there is shown in the drawings, and herein will be described in detail, a specific embodiment with the understanding that the present disclosure is to be considered an exemplification of the principles of the invention, and is not intended to limit the invention to that as illustrated and described herein.

As shown in FIG. 1, a handle assembly 10 includes a handle 6 and a mounting bracket 8. The handle assembly 10 is mounted to a storage box 12. The storage box 12 generally includes a front side 14, a rear side 16, a left side (not shown), a right side 18, a top 20 and a bottom 22. The front side 14 of the storage box 12 extends from the left side to the right side 18 of the storage box 12 and is generally perpendicular to the left and right sides 18 of the storage box 12. The top 20 of the storage box 12 extends from the front side 14 of the storage box 12 to the rear side 16 of the storage box 12. The top 20 is hingedly mounted to the rear side 16 of the storage box 12 can be lifted to an open position (as shown in FIG. 1) to provide access to an upper storage space 24.

The left and right sides 18 of the storage box 12 are identical. The right side 18 of the storage box 12 includes a right wall 26 and a recess 28 in which the handle assembly 10 is positioned. The recess 28 includes an upper wall 30, a lower wall 32, and inner wall 34, a front end wall 36 and a rear end wall 38. The recess 28 generally extends from the front side 14 of the storage box 12 to the rear side 16 of the storage box 12. The upper and lower walls 30, 32 are generally parallel to the bottom 16 of the storage box and extend inwardly from the right wall 26. The upper wall 30 has an outer edge 40 and an inner edge 42. The lower wall 32 has an outer edge 44 and an inner edge 46. An upper shoulder 48 is provided where the right wall 26 meets the outer edge 44 of the upper wall 30. A lower shoulder 50 is provided where the right wall 26 meets the outer edge 44 of the lower wall 32. The inner wall 34 extends from the inner edge 42 of the upper wall 30 to the inner edge 46 of the lower wall 32 and is generally parallel to the right side 26 of the storage box 12. The front end wall 36 and the rear end wall 38 are generally parallel to the front 14 and rear 16 sides of the storage box 12 and extend inwardly from the right wall 26. The inwardly extending dimension of the upper 30, lower 32, front end 36 and rear end 38 walls is slightly larger than the diameter of the material used to form the handle 6. Therefore, when the handle 6 is not in use (as shown in FIG. 1) the handle 6 is provided within the recess 28 of the right side 18 of the box 12 and does not extend beyond the right wall 26 of the box 12.

The mounting bracket 8 of the handle assembly 10 is shown in FIG. 2-5. The mounting bracket 8 generally includes a base portion 60, a front mounting element 62 and a rear mounting element 64.

Figure 4:
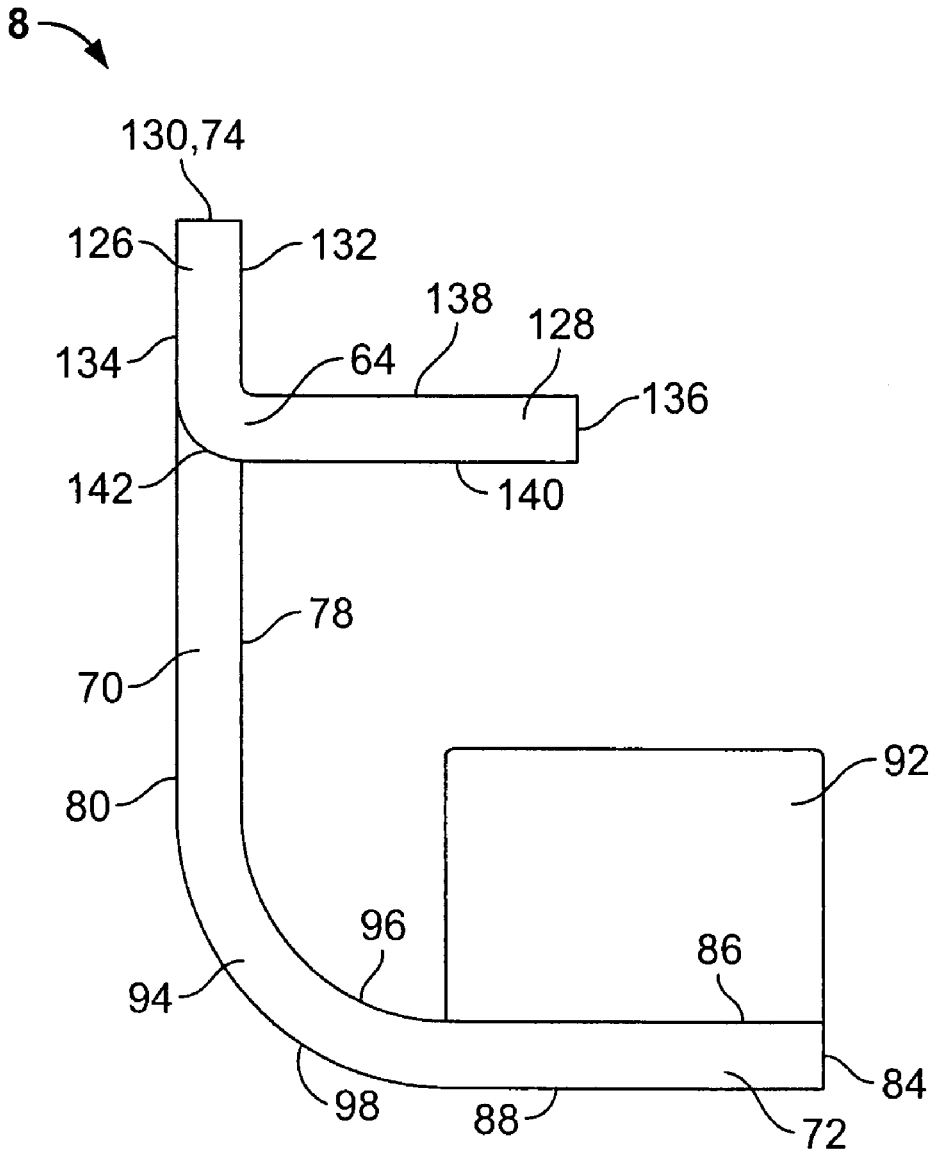
FIG. 4 is an end elevational view of the mounting bracket of FIG. 2.
Figure 6:
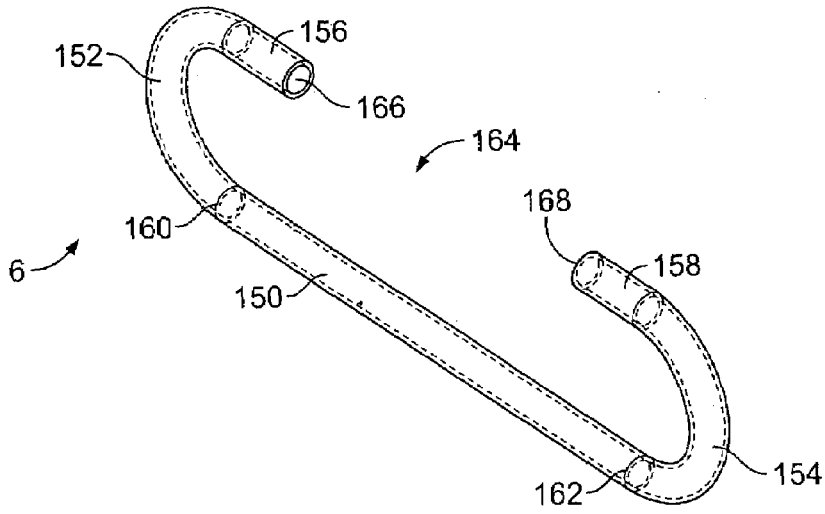
FIG. 6 is a perspective view of the handle of the handle assembly shown in FIG. 1.
Figure 7:
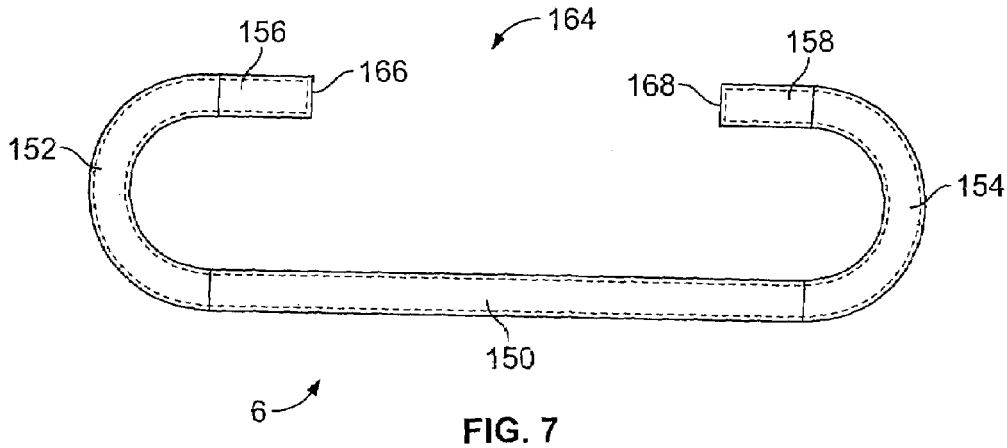
FIG. 7 is a side elevational view of the handle of FIG. 6.

The base portion 60 is generally elongated and L-shaped with opposite ends 66, 68. As best shown in FIG. 4, the base portion 60 includes a generally vertical first member 70 and a generally horizontal second member 72 which is generally perpendicular to the first member 70. The first member 70 includes an upper edge 74, an inner surface 78 and an outer surface 80. The second member 72 includes an inner edge 84, and upper surface 86 and a lower surface 88. An elongated rounded corner 94 is provided between the first member 70 and the second member 72. The corner 94 provides a curved inner surface 96 and a curved outer surface 98.

A front stop flange 90 and a rear stop flange 92 extend upwardly from the second member 72. The front stop flange 90 is spaced from the rear stop flange 92. The front stop flange 90 is spaced from the end 66 of the base portion 60 and the rear stop flange 92 is spaced from the end 68 of the base portion 60. The stop flanges 90, 92 are generally perpendicular to the first and second members 70, 72 of the base portion 60. A notch 91 is provided adjacent to the front stop flange 90 and a notch 93 is provided adjacent to the rear stop flange 92. Notch 91 results from formation of the front stop flange 90 and notch 93 results from formation of the rear stop flange 92.

The front mounting element 62 extends from the first member 70 of the base portion 60 proximate the upper edge 74 of the first member 70. The front mounting element 62 extends from the end 66 of the base portion 60. A rounded transition 100 is provided between the first member 70 of the base portion 60 and the front mounting element 62. The front mounting element 62 is also generally elongated and L-shaped. The front mounting element 62 includes a generally vertical first member 102 and a generally horizontal second member 104 which is generally perpendicular to the first member 102. The first member 102 includes an upper edge 106, an inner surface 110 and an outer surface 112. The upper edge 106 of the front mounting element 62 is coplanar with the upper edge 74 of the base portion 60. The inner and outer surfaces 110, 112 of the first member 70 are coplanar with the inner and outer surfaces 78, 80 of the first member 102 of the base portion 60. The second member 104 includes an inner edge 116, an upper surface 118 and a lower surface 120. The second member 104 is generally parallel to and spaced from the second member 72 of the base portion 60. A rounded corner 122 is provided between the first member 102 and the second member 104.

The rear mounting element 64 extends from the first member 70 of the base portion 60 proximate the upper edge 74 of the first member 70. The rear mounting element 64 extends from the end 68 of the base portion 60. A rounded transition 124 is provided between the first member 70 of the base portion 60 and the rear mounting element 64. The rear mounting element 64 is also generally elongated and L-shaped. The rear mounting element 64 includes a generally vertical first member 126 and a generally horizontal second member 128 which is generally perpendicular to the first member 126. The first member 126 includes an upper edge 130, an inner surface 132 and an outer surface 134. The upper edge 130 of the rear mounting element 64 is coplanar with the upper edge of the base portion 60. The inner and outer surfaces 132, 134 of the first member 126 are coplanar with the inner and outer surfaces 78, 80 of the first member 70 of the base portion 60. The second member 128 includes an inner edge 136, an upper surface 138 and a lower surface 140. The second member 128 is generally parallel to and spaced from the second member 72 of the base portion 60. A rounded corner 142 is provided between the first member 126 and the second member 128.

The mounting bracket 8 is preferably integrally formed by stamping and forming a single sheet of sheet metal. Although the mounting bracket 8 has been described as generally L-shaped, it is to be understood that the bracket could be of a variety of shapes. For example, the bracket could be arcuate-shaped.

The handle 6 of the handle assembly 10 is shown in FIGS. 6-9. The handle 6 is generally oval-shaped. The handle includes a grasping portion 150, a front end portion 152, a rear end portion 154, a front mounting portion 156 and a rear mounting portion 158.

The grasping portion 150 is generally elongated with a front end 160 and a rear end 162. The front end and rear end portions 152, 154 are generally U-shaped. The front end portion 152 extends upwardly from the front end 160 of the grasping portion 150 and the rear end portion 154 extends upwardly from the rear end 162 of the grasping portion 150. The front mounting portion 156 extends inwardly from the front end portion 152 and the rear mounting portion 158 extends inwardly from the rear end portion 154. An opening 164 is provided between the front mounting portion 156 and the rear mounting portion 158 such that first and second free ends 166, 168 of the handle 6 are provided.

The handle 6 is preferably formed from a single piece of steel tubing. Preferably the tubing from which the handle is formed has a circular cross-section.

To mount the handle assembly 10 to the storage box 12, the handle 6 is aligned with the mounting bracket 8 such that the front and rear mounting portions 156, 158 of the handle 6 are placed along a portion of the inner surface 96 of the elongated corner 94 of the mounting bracket 10. Next, the mounting bracket 8 is aligned with the right side 18 of the storage box 12 such that the inner surface 78 of the vertical member 70 of the base portion 60 and the inner surfaces 110, 132 of the vertical members 102, 126 of the front and rear mounting elements 62, 64 contact the right wall 26 of the storage box 12 and the upper surfaces 118, 138 of the horizontal members 104, 128 of the front and rear mounting elements 62, 64 contact the upper wall 30 of the recess 28 of the storage box 12. With the mounting bracket 8 properly aligned with the storage box 12, the front and rear mounting elements 62, 64 of the mounting bracket 8 are in contact with the storage box 8 and therefore, provide locations for fixedly attaching the mounting bracket 8 to the storage box 12. The mounting bracket 8 is then fixedly attached to the storage box 12 by, for example, riveting the mounting bracket 8 to the storage box 12 or welding the mounting bracket 8 to the storage box 12. Mounting of the handle assembly 10, therefore, requires very few steps and can be quickly and cost efficiently accomplished. Although FIG. 1 shows only the right side 18 of a storage box with a handle assembly 10 mounted thereon, it is to be understood that a handle assembly 10 is also mounted to the left side of the storage box 12 in an identical manner.

With the mounting bracket 8 attached to the storage box 12, the handle 6 is moveably attached to the storage box 12. The handle 6 can move in a front to rear direction and can rotate outwardly from the storage box 12. As the handle 6 moves in the front to rear directions, the front and rear mounting portions 156, 158 of the handle 6 slide along any of the surfaces 86, 78, 96 of the base portion 60 of the mounting bracket 8. This front to rear movement is, however, limited by the contact between the free ends 166, 168 of the handle 6 with the stop flanges 90, 92 of the mounting bracket 8. Because the front to rear movement of the handle 6 is limited by the stop flanges 90, 92, the free ends 166,168 are prevented from moving beyond the respective ends 66, 68 of the bracket 8 and therefore disengagement of the handle 6 from the bracket 8 is prevented.

The contact between the front and rear mounting portions 156, 158 of the handle 6 and the inner surfaces 78, 86, 96 of the base portion 60 provides a pivoting axis about which the handle 6 is rotated. The user grasps the grasping portion 150 of the handle 6 and lifts outwardly and upwardly to rotate the handle 6 to its in use position. Rotation of the handle 6 is limited through the engagement of the end portions 152, 154 of the handle 6 with the lower surfaces 120, 140 of the second members 104, 128 of the front and rear mounting elements 62, 64. Thus, the handle 6 is prevented from rotating more than approximately ninety degrees (90°). By limiting the rotation of the handle 6, the user's hand is spaced from the storage box 12 as the storage box 12 is carried. The user's hand, therefore, does not contact the storage box 12 and therefore additional comfort is provided to the user.

The handle assembly 10 can be used to lift, steer, or drag the storage box 12. When the handle 6 is not in use, the handle 6 can be used as a security tie down. Because the handle 6 lays flat against the side of the storage box 12, if a recess 28 is provided in the storage box 12, the handle does not extend beyond the outer 3 dimensions of the storage box 12.

While this invention has been described for use in connection with a storage box 12, it is to be understood that the handle assembly 10 could also be used in connection with mobile work benches or any other item which may need to be relocated from time to time.

While a preferred embodiment of the present invention is shown and described, it is envisioned that those skilled in the art may devise various modifications of the present invention without departing from the spirit and scope of the appended claims.

The invention claimed is:

1. A handle assembly for use in connection with an item to be lifted including:

a mounting bracket formed by stamping and forming a sheet of metal, said metal mounting bracket including a base portion, a first mounting element extending from a first end of said base portion, and a second mounting element extending from a second end of said base portion, said base portion being generally L-shaped and including first and second members with said second member extending away from said first member at a first predetermined angle, each of said first and second mounting elements being generally L-shaped and including first and second members with said second members extending away from said first members at a second predetermined angle;

a handle, said handle including first and second mounting portions, first and second end portions extending respectively from said first and second mounting portions, and a grasping portion between said first and second end portions, said first and second mounting portions having a generally constant cross-section; and wherein said first and second mounting portions of said handle are supported by said base portion of said metal mounting bracket, said handle pivots relative to said metal mounting bracket and the pivotal movement of said handle is limited by contact between said handle and said first and second mounting elements of said metal mounting bracket.

2. A handle assembly as defined in claim 1, wherein said pivotal movement of said handle is limited to approximately ninety degrees.

3. A handle assembly as defined in claim 1, wherein said base portion further includes at least one stop flange extending therefrom, said at least one stop flange configured to restrict side-to-side movement of said handle along said base portion of said metal mounting bracket.

4. A handle assembly as defined in claim 3, wherein said first end portion and said second end portion of said handle are generally U-shaped.

5. A handle assembly as defined in claim 1, wherein said handle is generally oval-shaped.

6. A handle assembly as defined in claim 1, wherein said handle includes a generally U-shaped first end portion and a generally U-shaped second end portion.

7. A handle assembly as defined in claim 1, wherein said first predetermined angle at which said second members of said mounting elements extend away from said first members of said mounting elements is approximately ninety degrees.

8. A handle assembly as defined in claim 7, wherein said second predetermined angle at which said second members of said mounting elements extend away from said first members of said mounting elements is approximately ninety degrees; and said first members of said first and second mounting elements are co-planar with said first member of said base portion.

9. A handle assembly as defined in claim 1, wherein said second predetermined angle at which said second members of said mounting elements extend away from said first members of said mounting elements is approximately ninety degrees.

10. A handle assembly in combination with an item to be lifted, said handle assembly comprising:

a mounting bracket mounted to said item, said mounting bracket being formed by stamping and forming a sheet of metal, said metal mounting bracket including a base portion, a first mounting element extending from a first end of said base portion, and a second mounting element extending from a second end of said base portion, said base portion being generally L-shaped and including first and second members with said second member extending away from said first member at a first predetermined angle, each of said first and second mounting elements being generally L-shaped and including first and second members with said second members extending way from said first members at a second predetermined angle;

a handle, said handle including first and second mounting portions, first and second end portions extending respectively from said first and second mounting portions, and a grasping portion between said first and second end portions, said first and second mounting portions having a generally constant cross-section; and wherein said first and second mounting portions of said handle are supported by said base portion of said metal mounting bracket, said handle pivots relative to said metal mounting bracket from a use position to a non-use position, and when said handle is in said non-use position, said handle does not extend beyond the dimensions of said item.

11. The combination as defined in claim 10, wherein the pivotal movement of said handle is limited by contact between said handle and said first and second mounting elements of said metal mounting bracket.

12. The combination as defined in claim 11, wherein the pivotal movement of said handle is limited to approximately ninety degrees.

13. The combination as defined in claim 10, wherein said base portion further includes at least one stop flange extending therefrom, said at least one stop flange configured to restrict side-to-side movement of said handle along said base portion of said metal mounting bracket.

14. The combination as defined in claim 10, wherein said first predetermined angle at which said second member of said base portion extends away from said first member of said base portion is approximately ninety degrees.

15. A box comprising:

a side wall including a recessed portion, a mounting bracket secured to said side wall, said mounting bracket being formed by stamping and forming a sheet of metal, said metal mounting bracket including a base portion, a first mounting element extending from a first end of said base portion and a second mounting element extending from a second end of said base portion, said base portion being generally L-shaped and including first and second members with said second member extending away from said first member at a first predetermined angle, each of said first and second mounting elements being generally L-shaped and including first and second members with said second members extending away from said first members at a second predetermined angle;

a handle, said handle including first and second mounting portions, first and second end portions extending respectively from said first and second mounting portions, and a grasping portion between said first and second end portions, said first and second mounting portions having a generally constant cross-section; and wherein said first and second mounting portions of said handle are supported by said base portion of said metal mounting bracket, said handle pivots relative to said metal mounting bracket, and the pivotal movement of said handle is limited by contact between said handle and said first and second mounting elements of said metal mounting bracket.

16. A box as defined in claim 15, wherein when said handle pivots from a non-use position to an in-use position and when said handle is in said non-use position, said handle does not extend beyond said side wall of said box.

17. A box as defined in claim 15, wherein said pivotal movement of said handle is limited to approximately 90 degrees.

18. A box as defined in claim 15, wherein said first predetermined angle at which said second member of said base portion extends away from said first member of said base portion is approximately ninety degrees.

19. A box as defined in claim 18, wherein said second predetermined angle at which said second members of said mounting elements extend away from said first members of said mounting elements is approximately ninety degrees; and said first members of said first and second mounting elements are co-planar with said first member of said base portion.

20. A box as defined in claim 15, wherein said second predetermined angle at which said second members of said mounting elements extend away from said first members of said mounting elements is approximately ninety degrees.

21. A box as defined in claim 15, wherein said base portion further includes at least one stop flange extending therefrom, said at least one stop flange configured to restrict side-to-side movement of said metal handle along said base portion of said mounting bracket.

22. A handle assembly for use in connection with an item to be lifted, said handle assembly comprising:

a mounting bracket including, a base portion having first and second ends, said base portion being generally L-shaped and including first and second members extending away from one another at approximately ninety degrees, said base portion having first and second stop flanges extending outwardly therefrom between said first and second members, said first stop flange being provided proximate to said first end of said base portion, said second stop flange being provided proximate to said second end of said base portion, a first mounting element extending outwardly from said first end of said base portion, said first mounting element being generally L-shaped and including first and second members extending away from one another at approximately ninety degrees, said first member of said first mounting element being connected to and being co-planar with said first member of said base portion, said second member of said first mounting element being generally parallel to said second member of said base portion, a second mounting element extending outwardly from said second end of said base portion, said second mounting element being generally L-shaped and including first and second members extending away from one another at approximately ninety degrees, said first member of said second mounting element being connected to and being co-planar with said first member of said base portion, said second member of said second mounting element being generally parallel to said second member of said base portion and being co-planar with said second member of said first mounting element;

a metal handle, said metal handle being bent into shape to include first and second mounting portions, first and second end portions extending respectively from said first and second mounting portions, and a grasping portion between said first and second end portions, said first and second mounting portions having a generally constant cross-section; and wherein said first and second mounting elements being configured to secure said mounting bracket to the item to be lifted, said first mounting portion of said metal handle being supported by said second member of said base portion between said first end thereof and said first stop flange, said second mounting portion of said metal handle being supported by said second member of said base portion between said second end thereof and said second stop flange, said first and second stop flanges being configured to restrict side-to-side movement of said metal handle along said base portion of said mounting bracket, said metal handle pivots relative to said mounting bracket and the pivotal movement of said metal handle is limited by contact between said metal handle and said first and second mounting elements of said mounting bracket.

23. A handle assembly for use in connection with an item to be lifted, said handle assembly comprising:

a mounting bracket including a base portion having first and second ends, said base portion having first and second stop flanges extending outwardly therefrom, said first stop flange being provided proximate to, but spaced from, said first end of said base portion, said second stop flange being provided proximate to, but spaced from, said second end of said base portion;

a handle including first and second mounting portions, first and second end portions extending respectively from said first and second mounting portions, and a grasping portion between said first and second end portions, said first and second mounting portions having a generally constant cross-section; and wherein said first and second mounting portions of said handle are supported by said base portion of said mounting bracket, said handle pivots relative to said metal mounting bracket from a use position to a non-use position, said handle further being configured to move from side-to-side along said base portion of said mounting bracket, said side-to-side movement of said handle being restricted when said first mounting portion of said handle contacts said first stop flange or when said second mounting portion of said handle contacts said second stop flange.

24. The handle assembly as defined in claim 23, wherein said mounting assembly is formed by stamping and forming a sheet of metal.

* * * * *